United States Patent [19]

Robison

[11] Patent Number: 5,033,862

[45] Date of Patent: Jul. 23, 1991

[54] PARTICULATE MATERIAL MIXING SYSTEM

[76] Inventor: Stephen J. Robison, 187 North 100 West, Fillmore, Utah 84631

[21] Appl. No.: 570,153

[22] Filed: Aug. 17, 1990

[51] Int. Cl.[5] ..... B01F 15/02

[52] U.S. Cl. ..... 366/183; 366/185; 366/300

[58] Field of Search ..... 366/54, 56, 57, 63, 366/187, 208, 217, 218, 220, 349, 183, 185, 300; 105/264, 265, 266, 267

[56] References Cited

U.S. PATENT DOCUMENTS

| | | | |
|---|---|---|---|
| 1,911,514 | 5/1933 | Kernan | 366/54 |
| 1,980,130 | 11/1934 | Fasting | 366/56 |
| 2,161,485 | 6/1939 | Puccinelli | 366/135 |
| 2,513,352 | 7/1950 | O'Meara | 366/217 |
| 2,638,625 | 5/1953 | Studebaker | 366/208 |

*Primary Examiner*—Harvey C. Hornsby
*Assistant Examiner*—Terrence R. Till
*Attorney, Agent, or Firm*—Thorpe, North & Western

[57] ABSTRACT

A method and apparatus of mixing particulate matter carried on a tray includes moving the tray onto a support structure which securely holds the tray, rotating the support structure, with tray, to an upside-down position over a bin, which is mounted in the support structure, so that the particulate material falls from the tray into the bin and mixing the particulate material in the bin. The support structure is then rotated, again with tray, to a rightside-up position, and the bin to an upside-down position, so that the particulate material falls from the bin back into the tray. The tray is then moved from off the support structure and the particulate material which is now mixed placed into use as desired by the user.

14 Claims, 2 Drawing Sheets

SPAWN MIXING UNIT AND DESTACKER

PARTICULATE MATERIAL MIXING SYSTEM

BACKGROUND OF THE INVENTION

The present invention relates to a method and apparatus for mixing particulate material such as compost, mushroom spawn and supplement, and like materials.

Planting and cultivation of mushrooms are carried out by pre-mixing mushroom spawn (seed) and supplement (fertilizer) with a special type of compost and then placing the resulting composite mixture in an appropriate environment for growing of the mushrooms. Typically, conventional mushroom growing trays are first filled with the compost, spawn and supplement are then deposited on the top of compost in the trays, and then mixing is carried out by hand to uniformly distribute the spawn and supplement throughout the compost. The trays are then taken to a greenhouse or other environment where the temperature and humidity are either predictable or can be carefully controlled. Of course, mixing the compost, spawn and supplement by hand is labor intensive and therefore and quite costly.

Mixing devices have been developed for automatically mixing the compost, spawn and supplement, but such devices typically utilize elaborate and expensive conveyor systems, material emptying and refilling apparatus, etc., or still require the manual emptying of the trays into the devices, operating the devices to mix the material, and then emptying the material from the devices back into the trays. Such mixing devices are thus either quite expensive or still require significant manual intervention and so are labor intensive.

SUMMARY OF THE INVENTION

It is an object of the invention to provide a simple and efficient method and apparatus for mixing mushroom compost/spawn/supplement and like particulate material.

It is also an object of the invention to provide such a method and apparatus which is reliable, can be readily automated, and is inexpensive to construct and use.

It is a further object of the invention to provide such a method and apparatus in which conventional mushroom growing trays or the like can be utilized and retained during the mixing process.

The above and other objects of the invention are realized in a particulate material mixing system which includes a frame rotatable about a generally horizontal axis, a carriage mounted in the frame for receiving and holding a tray which carries particulate material, such as mushroom compost/spawn/supplement, and a bin mounted upside down in the frame above the carriage. Mixer blades are rotatably disposed in the bin to mix any particulate matter which is received in the bin.

In use, a tray with particulate material is supplied to the frame and is received by the carriage. The frame is then rotated, either manually or automatically under power, to also rotate the carriage and tray to an upside-down position so that the particulate material in the tray falls from the tray into the bin which is now in a right-side-up position. With the particulate material in the bin, the mixer blades are caused to rotate to mix the particulate material together, after which the frame with tray and bin are rotated again to move the tray to a rightside-up position and the bin to an upside-down position. The mixed particulate material then falls from the bin back onto the tray and the tray may be removed from the frame for whatever purposes the particulate material is to be put.

BRIEF DESCRIPTION OF THE DRAWINGS

The above and other objects, features and advantages of the invention will become apparent from a consideration of the following detailed description presented in connection with the accompanying drawings in which.

DETAILED DESCPIPTION

Figure 1:
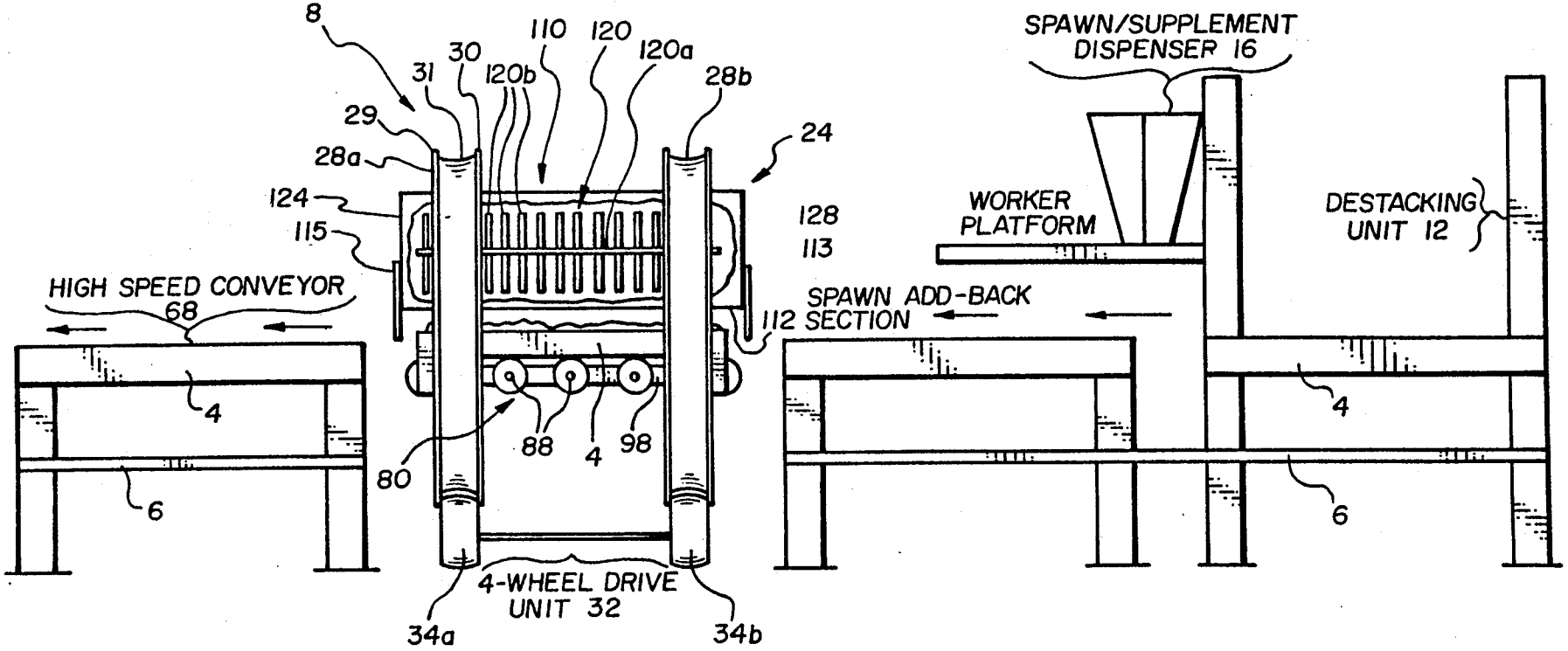
FIG. 1 is a side, graphic, partially cutaway view of a particulate material mixing system made in accordance with the principles of the present invention and shown in a conventional conveyor line.

Referring to FIG. 1, there is shown a particulate material mixing system disposed in a conventional mushroom compost/spawn/supplement conveyor line. The conveyor line is shown graphically to generally indicate the stations at which various activities take place to prepare a tray 4 of compost, spawn and supplement for growing mushrooms. (The trays 4 shown in the drawings are conventional mushroom growing trays having a top surface for holding compost/-spawn/supplement, supported by four legs.) Trays 4 are automatically supplied by a conveyor 6 to a mixing system 8 from a destacking unit 12. The trays 4 are moved, with compost loaded thereon, from the destacking unit 12 to a position under a spawn/supplement dispenser 16. The dispenser 16 dispenses a mixture of spawn and supplement onto the top of the compost carried by the trays according to a predetermined metered formula.

The trays 4, with compost, spawn and supplement, are then moved to the mixing system or unit 8, one at a time, where mixing of the particulate material carried by the trays will be done as described hereafter. From the mixing unit 8, the trays 4 move back onto the conveyor 6 for transport to a mushroom growing location, shipping location, etc. The conveyor 6, destacking unit 12 and spawn/supplement dispenser 16 are all prior art mechanisms.

Figure 2:
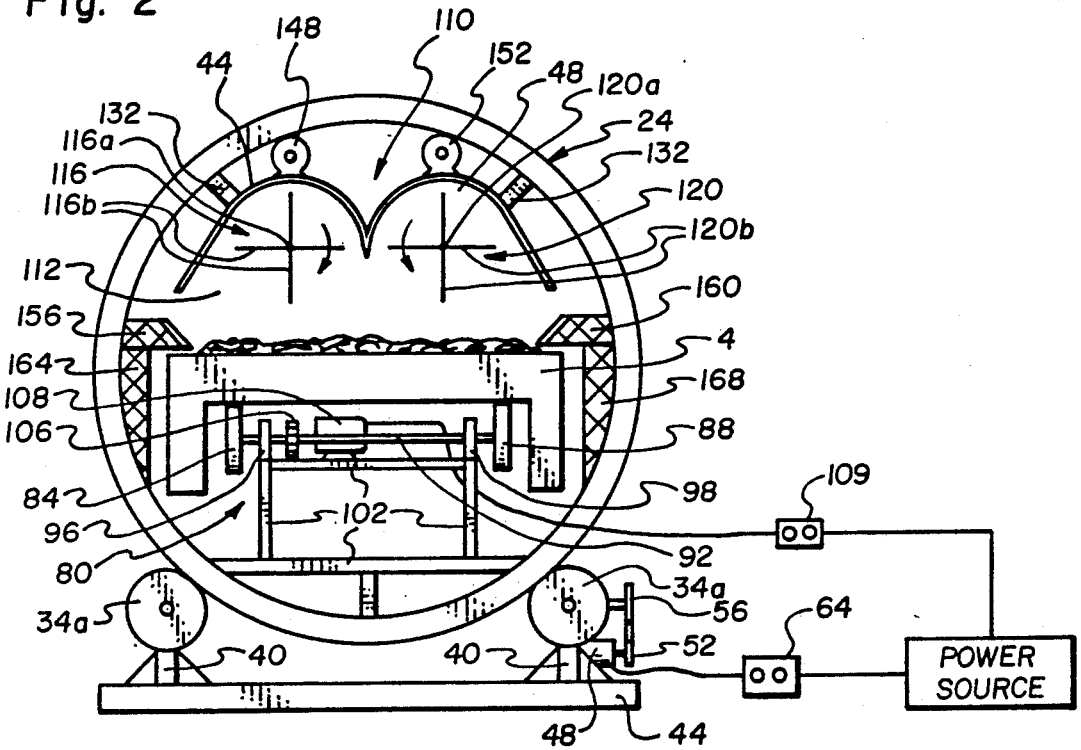
FIG. 2 is an end, elevational, partially cross-sectional view of the particulate material mixing system of claim 1.
Figure 3:
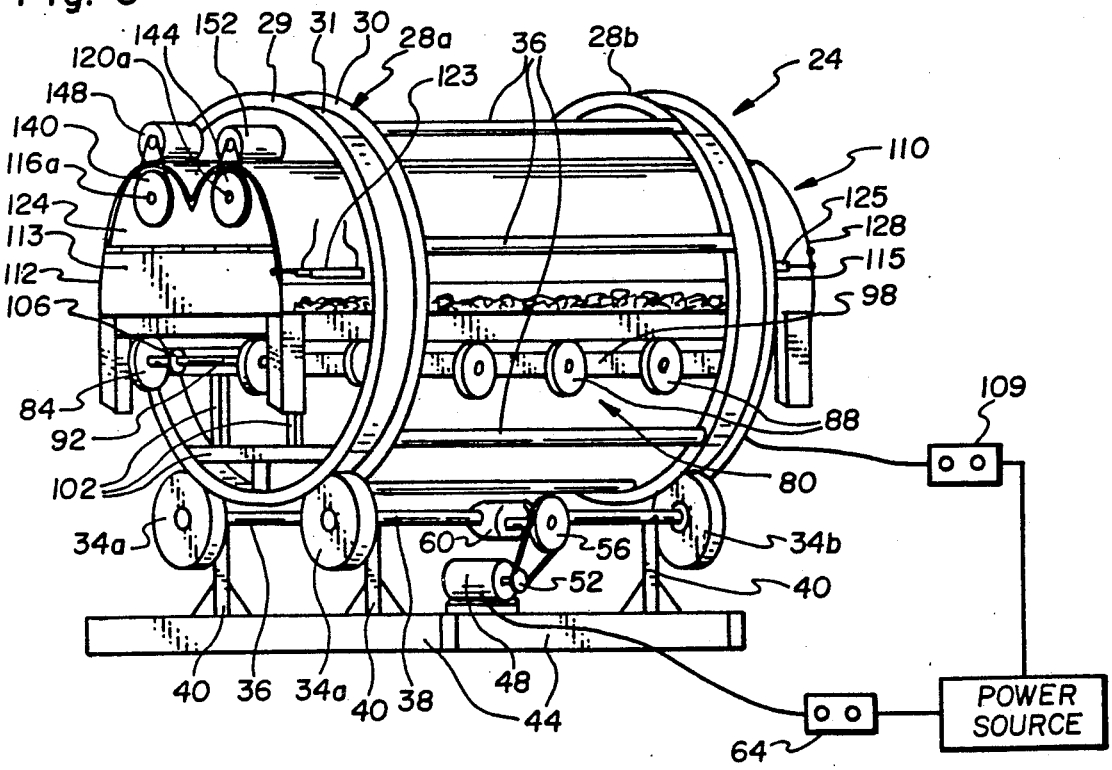
FIG. 3 is a perspective view of the system of FIG. 2.

The mixing unit 8, shown best in FIGS. 2 and 3, includes a frame 24 made of a pair of circular tracks **28*a* and 28*b* which are positioned in a spaced-apart, coaxial relationship, with the planes defined by the tracks being generally parallel with one another. Each track 28 is formed to define a radially outwardly facing channel having a generally U-shaped cross-section with side walls 29 and 30 and a bottom wall 31, into which respective sets of drive wheels 34*a* and 34*b* are rollingly received. The frame 8 further includes connecting struts 36 to rigidly hold the tracks 28 in the desired spaced-apart relationship. The tracks 28*a* and 28*b*, and struts 36** might illustratively be made of steel or other metallic alloy.

Each set of drive wheels **34*a* and 34*b* supports respective tracks 28*a* and 28*b* to cause the tracks to rotate when the wheels are caused to rotate. The drive wheels 34*a* are joined by respective axles 36 and 38 to respective ones of the drive wheels 34*b*, and the axles are rotatably supported by legs 40 which, in turn, are mounted on respective base bars 44. An electric motor 48 (or hydraulic motor) is provided to selectively drive the two drive wheels connected together by axle 38**.

The motor 48 is coupled by a drive pulley 52 to a driven pulley 56 which is connected to a differential gear 60 which, in turn, is connected to the axle 38, all in a conventional manner. The motor 48 may be operated under control of a control switch 64 (or hydraulic valve) to rotate the drive wheels 34*a* and 34*b* in either direction to thereby cause the frame 24 to rotate in either direction (about a generally horizontal axis), for purposes to be discussed hereafter.

Disposed in the frame 24 is a carriage 80 for receiving and holding trays 4 to allow mixing of the particulate material carried by the trays. The carriage 80 includes two generally parallel rows of rotatable wheels 84 and 88, the tops of which generally define a plane in which the trays 4 are carried. Each of the wheels 84 and 88 are rotatable in a plane parallel with the planes of rotation of the other wheels so that the trays 4 may be moved along the tops of the wheels in a generally linear path. The wheels 84 are joined to respective wheels 88 by a respective axles 92 which are rotatably mounted in elongate, parallel, spaced-apart support rails 96 and 98. The support rails 96 and 98 are, in turn, mounted by support struts 102 in the frame 24 and in particular within the circular tracks 28*a* and 28*b*.

The sets of wheels 84 and 88 may be "free-wheeling" or they may be power driven to, in effect, pull and carry a tray to the desired position within the frame 24. If power driven, sprockets, such as sprocket 106 shown in FIGS. 2 and 3, would be fixedly mounted on the axles 92 and chain driven by an electric motor 108 (or hydraulic motor) to cause the axles and thus the wheels 84 and 88 to rotate in a direction determined by the direction of operation of the motor, under control of a control switch 109. The motor 108 is simply coupled by a sprocket mounted on its drive shaft to a drive chain which, in turn, is coupled to the sprockets 106 mounted on the axles 92, all in a conventional fashion.

Mounted above the carriage 80 in an upside-down disposition is a bin 110. The bin is formed with an opening 112 and a bottom wall (although shown as being on top in the figures) having a two-lobed end cross section. Each of the lobes of the bottom wall are formed to be generally semicylindrical, as best seen in FIG. 2, to accommodate rotary beaters or mixing elements 116 and 120. End walls 124 and 128, on which are hingedly mounted doors 113 and 115 respectively to swing outwardly and upwardly, complete the enclosure of the bin volume. The bin 110 is mounted by brackets 132 in fixed relation to the circular tracks 28*a* and 28*b* (FIG. 2). The doors 113 and 115 are automatically opened and closed by hydraulically driven pistons 123 and 125 (FIG. 3) respectively, which would be connected to a hydraulic power source and operated by a control switch.

The mixing elements 116 and 120 each include an elongate shaft 116*a* and 120*a* respectively which are rotatably disposed to be generally parallel with the cylindrical axes of the corresponding lobe of the bin 110. Radially extending from the shafts 116*a* and 120*a* are a plurality of elongate, longitudinally spaced-apart blades 116*b* and 120*b* respectively. The shafts 116*a* and 120*a* are mounted to rotate in opposite directions in the bin 110, with the shafts extending through bearings in the end walls 124 and 128 of the bin. Pulleys 140 and 144 are mounted on the ends of shaft 116*a* and 120*a* respectively and are belt driven by motors 148 and 152 respectively (FIG. 3).

Referring to FIG. 2, bumper stop elements 156 and 160 are mounted on opposite sides of the two circular tracks 28*a* and 28*b* just above the side edges of the trays 4 (when the trays are resting on the carriage 80) so that upon rotation of the circular tracks, the trays 4 will be turned upside down and come to rest on the stop elements. Also mounted on opposite sides of the circular tracks 28*a* and 28*b* are side guides 164 and 168 which prevent significant sideward movement of the trays 4, again when the tracks are rotated.

In operation, doors 113 and 115 are opened (swung outwardly and upwardly) and a tray 4 is moved to a position where the underneath side is contacted by the tops of first encountered wheels 84 and 88 which, if power driven, pull the tray 4 to a position in the frame 24 just below the bin 110. The doors 113 and 115 are then closed. If the wheels 84 and 88 are not power driven, then the tray is simply manually moved into position beneath the bin 110. The motor 48 is then operated to cause the drive wheels 34*a* and 34*b* to rotate and thus rotate circular tracks 28*a* and 28*b* until the bin 110 is rightside up and the carriage 80 and tray 4 are upside down. Of course, in this position, the particulate material carried by the tray 4 falls from the tray into the bin 110. The mixer elements 116 and 120 are then caused to rotate so that the blades 116*b* and 120*b* counter rotate to contact, agitate and mix the particulate material as desired. After a predetermined period of time, the mixing elements 116 and 120 are stopped, the wheels 34*a* and 34*b* are caused to rotate in the opposite direction of the previous rotation (or just further in the same direction as the previous rotation) to thereby rotate the tracks 28*a* and 28*b* to a position where the bin 110 is again upside down and the carriage 80 and tray 4 are rightside up. In this position, the particulate material which is now mixed falls from the bin 110 back onto the tray 4, and the tray is then moved from under the bin to the next station of the conveyor 6 (FIG. 1). From here, the tray 4 may be moved to whatever destination is desired by the user.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

I claim:

1. A particulate material mixing system comprising a frame rotatable about a generally horizontal axis, carriage means mounted in the frame for receiving and holding a tray which carries particulate material, a bin mounted upside down in the frame above the carriage means to receive particulate material which falls from the tray as the frame and tray are rotated to an upside-down position, and to discharge particulate material back onto the tray as the frame and tray are rotated back to a rightside-up position, means for mixing particulate material received in the bin, and power means for selectively causing the frame to rotate from the rightside-up position to the upside-down position and vice-versa.

2. A system as in claim 1 wherein said frame comprises first and second circular tracks spaced apart to circumscribe the axis of rotation of the frame, said carriage means and bin being mounted within the two circular tracks, and wherein said power means comprises first and second pairs of rotatable wheels disposed circumferentially to support the first and second tracks respectively and to cause the tracks to rotate when the wheels are rotated.

3. A system as in claim 2 wherein each of said circular tracks is formed to have a generally U-shaped end cross-section to mutually rollingly receive a corresponding pair of wheels.

4. A system as in claim 3 wherein said power means further comprises motor means drivingly coupled to at least one of the wheels of said first or second pair of wheels.

5. A system as in claim 1 wherein said carriage means comprises two generally parallel rows of rotatable wheels, the tops of said wheels generally defining a plane in which the tray is carried to a position under the bin, and each wheel being generally rotatable in a plane which is parallel with the planes of rotation of the other wheels.

6. A system as in claim 5 wherein said carriage means further comprises means for selectively driving at least some of the wheels to rotate to thus move the tray thereover to a position under the bin.

7. A system as in claim 1 further comprising stop means mounted on the frame between the bin and the carriage means for preventing sideward or upward movement of the tray beyond certain distances when the frame is rotated.

8. A system as in claim 8 wherein said stop means comprises bumpers located above the surface of the tray when the tray is disposed on the carriage means, to receive and support the tray when the frame is rotated upside down, and guides located at the sides of the tray when the tray is disposed on the carriage means to contact and prevent sideward movement of the tray when the frame is rotated.

9. A system as in claim 1 wherein said bin is formed with a generally semi-cylindrically-shaped bottom wall, and wherein said mixing means comprises an elongate shaft rotatably disposed in the bin in proximity to the bottom wall to be generally parallel with the cylindrical axis thereof, a plurality of elongate blades extending radially outwardly from the shaft to contact and mix particulate material received into the bin, when the shaft is rotated, and motor means for selectively causing the shaft to rotate.

10. A system as in claim 9 wherein said bin further includes two end walls formed at respective ends of the bottom wall to define a cavity for receiving the particulate material, and two doors, each hingedly mounted on a respective end wall to swing outwardly and upwardly when the bin is upside down to allow trays to be received by the carriage means, and to swing downwardly and inwardly towards respective opposite ends of a tray which has been received by the carriage means.

11. A system as in claim 9 wherein said bin is further formed with a second semi-cylindrically-shaped bottom wall positioned to one side of and generally parallel with the first-mentioned bottom wall, and wherein said mixing means further comprises a second elongate shaft rotatably disposed in the bin in proximity to the second bottom wall to be generally parallel to the cylindrical axis thereof, a second plurality of elongate blades extending radially outwardly from the second shaft to contact and mix particulate material received into the bin on the second bottom wall, when the second shaft is rotated, and second motor means for selectively causing the second shaft to rotate.

12. A method of mixing particulate material carried on a tray comprising (a) moving the tray onto a support structure which securely holds the tray, (b) rotating the support structure, with tray, to an upside-down position over a bin so that the particulate material falls from the tray into the bin, (c) mixing the particulate material in the bin, (d) rotating the support structure, with tray, to a rightside-up position, and the bin to an upside-down position so that the particulate material falls from the bin back onto the tray, and (e) moving the tray from off the support structure.

13. A method as in claim 12 wherein the bin is mounted on the support structure in a normally upside-down position over the position occupied by the tray when the tray is moved onto the support structure, and wherein step (b) further comprises rotating the bin from an upside-down position to a rightside-up position to receive particulate matter falling from the tray.

14. A method as in claim 12 wherein step (c) comprises mixing the particulate material with a rotating beater element.

* * * * *